US005372053A

United States Patent [19]

Lee

[11] Patent Number: 5,372,053

[45] Date of Patent: Dec. 13, 1994

[54] HAMMER

[76] Inventor: Chang C. Lee, 429-6, Chung Cheng Road, Tsaotun, Nantou, Taiwan, Prov. of China

[21] Appl. No.: 160,674

[22] Filed: Dec. 2, 1993

[51] Int. Cl.[5] ..... B25D 1/00

[52] U.S. Cl. ..... 81/20; 81/22

[58] Field of Search ..... 173/90; 81/20, 21, 22, 81/23, 24, 25, 26

[56] References Cited

U.S. PATENT DOCUMENTS

| | | | |
|---|---|---|---|
| 1,194,170 | 8/1916 | Grossman | 81/20 |
| 1,582,305 | 4/1926 | Reichling | 81/20 |
| 2,755,833 | 7/1956 | Quayle | 81/25 |
| 3,211,198 | 10/1965 | Glasgow | 81/26 |
| 4,266,588 | 5/1981 | Tudisco | 81/22 |
| 4,440,206 | 4/1984 | Dart | 81/20 |
| 4,683,784 | 8/1987 | Lamont | 81/22 |
| 4,753,137 | 6/1988 | Kennedy | 81/25 |

FOREIGN PATENT DOCUMENTS

| | | | |
|---|---|---|---|
| 2227181 | 12/1973 | Germany | 81/20 |

*Primary Examiner*—Scott A. Smith

*Attorney, Agent, or Firm*—Bacon & Thomas

[57] ABSTRACT

An improved hammer is composed of a handle and a head fastened to the one end of the handle. The head is provided centrally with a hole for receiving therein a threaded rod of the handle. The hole of the head is provided in the outer end thereof with a threaded area. Located at the side opposite to the threaded area is a polygonal area having a section polygonal in shape and greater than that of the threaded area. In addition to the threaded rod engageable with the threaded area of the head, the handle further comprises a casing of plastic material covering entirely the threaded rod and filling the gap formed between the threaded rod and the polygonal area of the hole of the head.

11 Claims, 3 Drawing Sheets

HAMMER

FIELD OF THE INVENTION

The present invention relates generally to a hammer, and more, particularly to an improved hammer having a head which is not only fastened secretly across one end of a handle, but the head is fastened in way such that the shock generated by the pounding of the head is partially absorbed.

BACKGROUND OF THE INVENTION

The conventional hammer is composed of a head and a had which are fastened together intimately. The head is provided with a tetragonal or round hole while the handle is provided with one end of tetragonal or round construction and having a tapered sectional area for fitting forcibly into the tetragonal or round hole of the head. The handle is generally made of wood or fiber reinforced plastic composite material. Such a conventional hammer as described above is defective in design in that the head and the handle are vulnerable to becoming loosened after a prolonged use of the hammer. A gooseneck head of the hammer is potentially hazardous to the safely of the persons and the instruments at the work place.

With a view to overcoming the drawback of the conventional hammer described above, the conventional hammer is further provided with a wedge, which is forced into the tetragonal or round hole of the head after the tetragonal or round end of the handle is fitted into the hole. The use of the wedge as a means to reinforce the fastening of the head with the handle can only delay the onset when the head and the handle of the hammer become loosened. In other words, such a band aid approach to the remedy of the problem does not remedy the purpose of overcoming the aforementioned drawback of the conventional hammer. In addition, the use of the wedge to reinforce the fastening of the head with the handle can inevitably result in a substantial increase in the overall cost of making the hammer.

A further attempt was made to improve the situation described above by providing the hammer with a metal head and a handle, which are made integrally at the time when tile metal head is forged. The handle is formed integrally with tile head in a manner such that the handle is perpendicular to the inner side surface of the metal head. The handle is covered with a shock-absorbing casing of rubber for mitigating the shock generated by the pounding of the head. It is readily apparent that such a forged hammer as described above has successfully solved the problem of the conventional hammer; nevertheless the forged hammer with the integrally-made head and handle can not be made easily and economically. In addition, the shock wave generated by the pounding of the head of the forged hammer can turn out at times to be almost unbearable to the hand of a person holding the hammer. There is still another conventional hammer, which is composed of a metal handle having a forked end riveted to a metal head. The metal handle is covered with shock-absorbing casing of rubber. However, the rubber casing is not effective inn mitigating the shock generated by the pounding of tile head. In addition, the manufacture of this conventional hammer is not cost effective.

SUMMARY OF THE INVENTION

It is, therefore, the primary objective of the present invention to provide an improved hammer with means capable of overcoming the shortcomings of the conventional hammers described above.

A further objective of the present invention is to provide a method of making the improved hammer.

In keeping with the principle of the present invention, the foregoing objectives of the present invention are accomplished by a hammer consisting of a handle and a metal head fastened to one end of the handle. The head is provided centrally with a hole for receiving therein said one end of the handle. The hole of the metal head is provided therein with a threaded area located at the side thereof farther to the handle. Located at the side opposite to the side of the threaded area of the hole is a polygonal area having a section greater than that of the threaded area. The handle comprises a threaded rod of metal and a casing of plastic material. One end of the threaded rod is threadedly engaged with the threaded area of the hole via the polygonal area of the hole of the head. The casing of plastic material. One end fills the gap formed between the threaded rod and the polygonal area of the hole of the head and securely receives the portion of the threaded rod which protrudes from the polygonal area of the hole of tile head.

The head and threaded rod used in the hammer of the present invention can be made of any suitable materials known in the art in addition to metal.

The construction of the head and the handle of the present hammer may also be applied to other hand tools which require a connecting construction between a handle and a working piece thereof, such as axes.

DETAILED DESCRIPTION OF THE INVENTION

Figure 1:
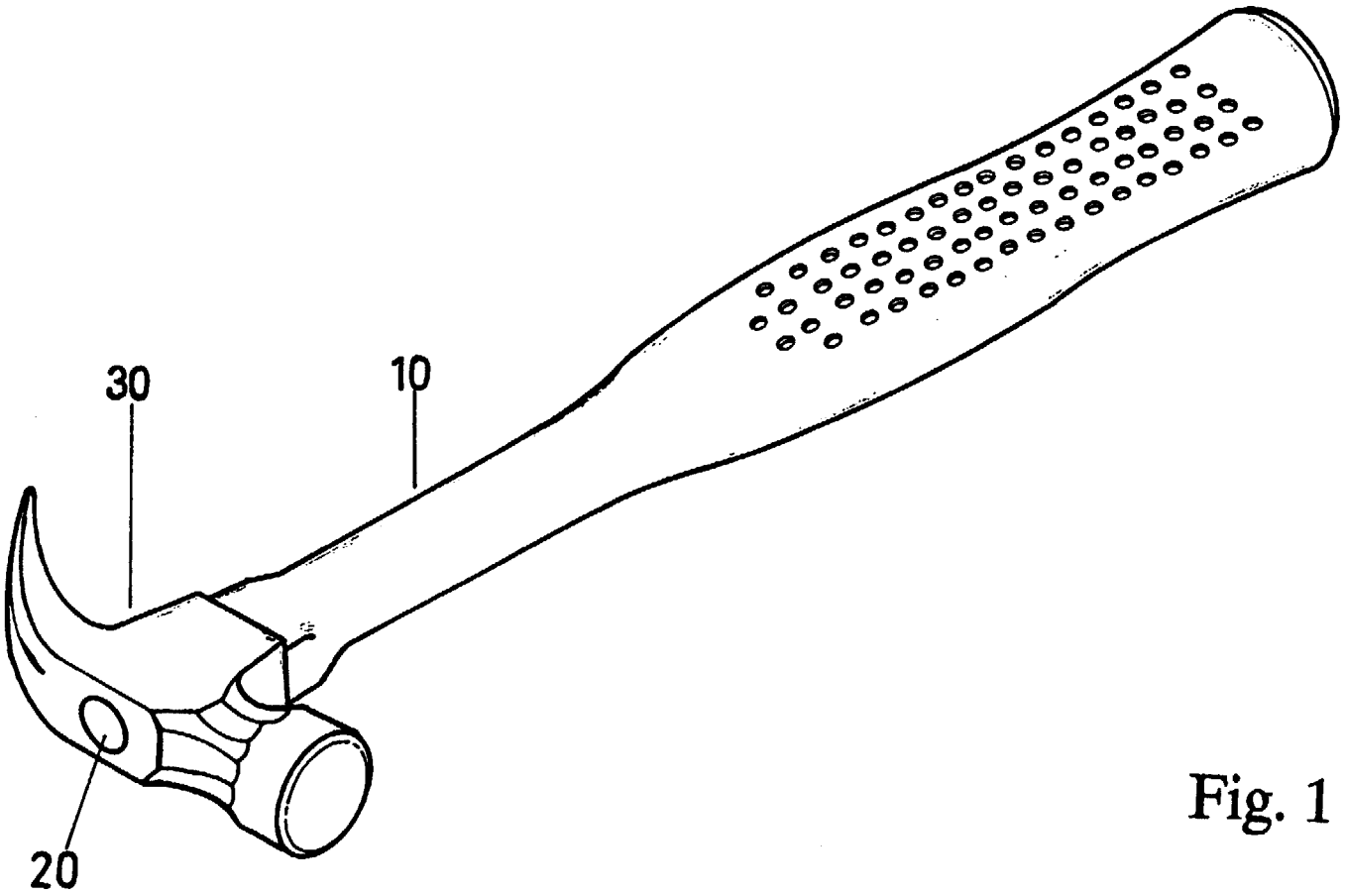
FIG. 1 shows a perspective view of a first preferred embodiment of the present invention.
Figure 2:
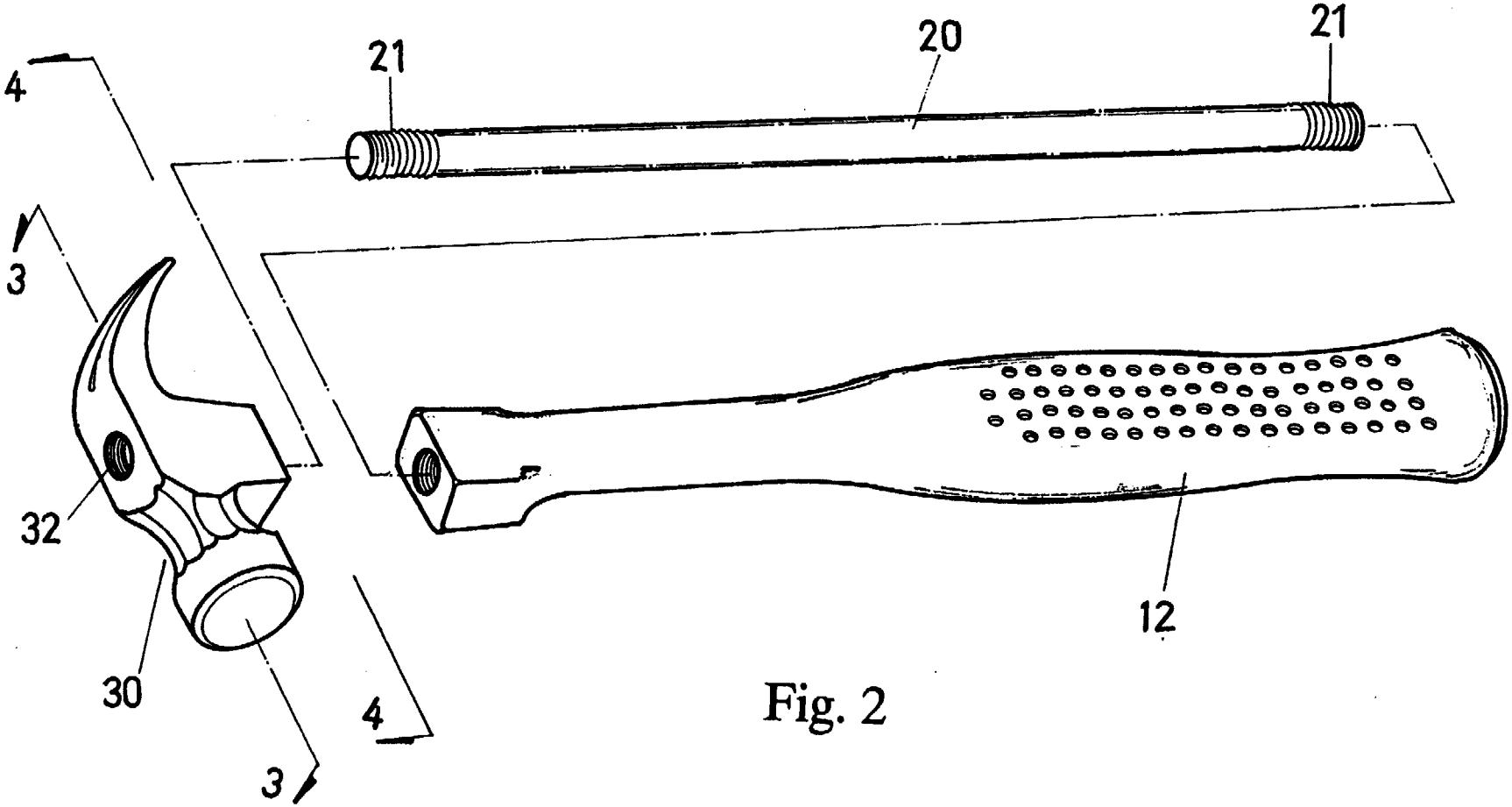
FIG. 2 shows an exploded view of the first preferred embodiment as shown in FIG. 1.

Referring to FIGS. 1-4, a hammer of the first preferred embodiment of the present invention is shown to comprise a handle 10 and a forged head 30 of metal. The metal head 30 is provided centrally with a hole 31 dimensioned to receive therein one end of the handle 10. The hole 31 is provided in the outer end thereof with a threaded area 32 and in the inner end thereof with a tetragonal area 33 which is in communication with the threaded area 32 and has a section greater than that of the threaded area 32. The handle 10 is made up of a threaded rod 20 and an casing 12 of polyvinyl chloride, in which the threaded rod 20 is enclosed. The threaded rod 20 is provided at the outer surface thereof with a threaded partition 21 engageable with the threaded area 32 of the hole 31 of the head 30. In other words, the threaded rod 20 of the handle 10 is first fastened with the head 30 by means of the threaded portion 21, which is pelt through the tetragonal area 33 of the hole 31 so as to engage the threaded area 32 of the hole 31 of the head 30. A suitable process of making the casing 12 of the handle 10 of the present embodiments includes arranging the head 30 with the threaded rod 20 fastened thereto in the mold cavity of a plastic molding device (not shown in the drawings) before the molten polyvinyl chloride (PVC) is injected into the unoccupied space of the mold cavity. Thereafter, the molding device is allowed to cool before it is opened to remove therefrom a newly formed hammer comprising the head 30 with the threaded rod 20 fastened thereto and enclosed in the PVC casing 12 which has an anterior end substantially filling the gap formed between the tetragonal area 33 of the hole 31 of the head 30. In addition, the casing 12 is shaped like a handle in its entirety and provided with a hand grip having in the outer surface thereof a plurality of uniformly-distributed circular recesses serving to facilitate the user of the hammer of the present invention to hold fast with the hand, as shown in FIGS. 1 and 2.

The hammer of the present invention, as described above in conjunction with FIGS. 1–4, can be made by a method comprising the following steps of:

(a) preparing a threaded rod;

(b) forging a metal head provided centrally with a half-through tetragonal opening;

(c) punching a round hole at tile center of the bottom of the half-through tetragonal opening of tile metal head;

(d) providing the round hole of the metal head with a threaded inner wall engageable with the threaded roll;

(e) fastening the threaded rod with tile metal head by inserting one end of the threaded rod into the tetragonal opening so that the threaded rod engages the threaded inner wall of the round hole of the metal head; and (f) arranging the metal head having the threaded rod fastened thereto in a plastic molding device and then forming a plastic casing to contain the threaded rod with one end of the plastic casing substantially filling the gap formed between the tetragonal opening of tile metal head and the outer surface of the threaded rod.

Figure 5:
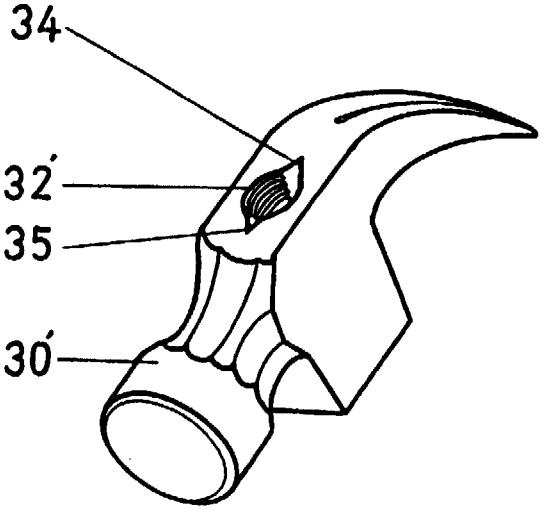
FIG. 5 shows a perspective schematic view of the hammer head of a second preferred embodiment of the present invention.
Figure 4:
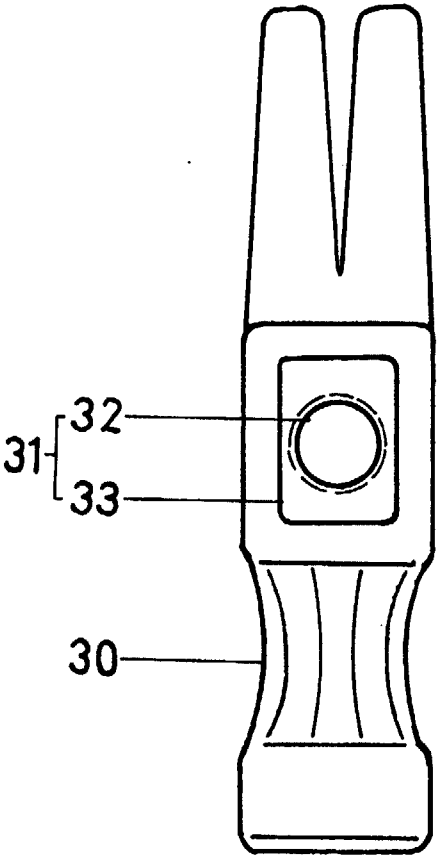
FIG. 4 shows a side view taken along the line 4—4 as shown in FIG. 2.
Figure 3:
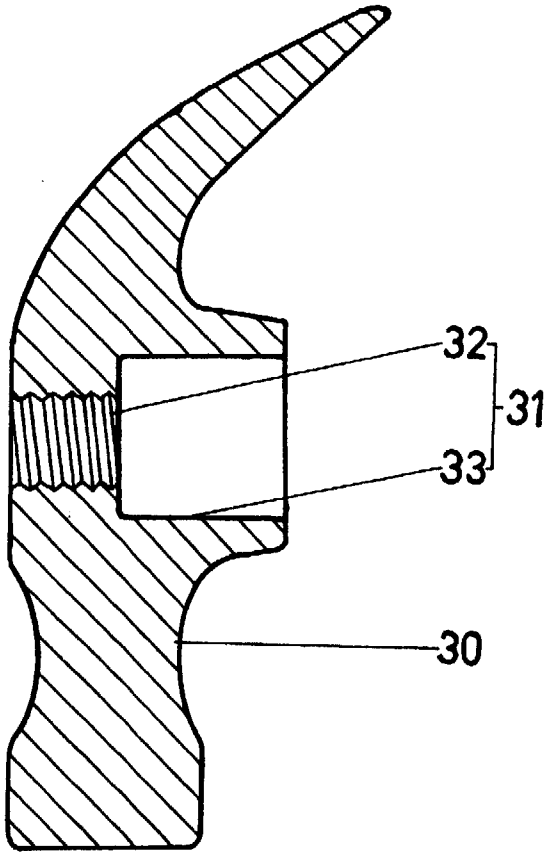
FIG. 3 shows a sectional view taken along the line 3—3 as shown in FIG. 2.

A head 30' used in a hammer of the second preferred embodiment of the present invention is shown in FIG. 5. The hammer of tile second preferred embodiment is similar in construction to the hammer of the first preferred embodiment of the present invention. However, the head 30' of the second preferred embodiment is provided with a threaded area 32' in an oval hole having a partially threaded inner wall. The open end of tile threaded area 32' is provided with two shallow slots 34 and 35, which are opposite in location to each other. The shallow slots 34 and 35 and the gap formed between the threaded area 32' and a round threaded rod (not shown in FIG. 5) are filled with PVC during a process similar to the process of making the PVC casing 12 in the first preferred embodiment of the present invention, in which the PVC casing 12 is formed in the plastic molding device.

It is apparent that the head 30 of the first preferred embodiment and the head 30' of the second preferred embodiment may also be made of materials other than metal, such as an engineering plastic material, a ceramic material and a fiber-reinforced plastic composite material.

Various modification can be made based on the preferred embodiments of the present invention. For examples, the hole 31 of the head 30 may be a half-through hole. The tetragonal area 33 can define a section of a regular or irregular shape which may be triangular, pentagonal, hexagonal, heptagonal, octagonal or oval. The threaded rod 20 may have an outer surface which is threaded at one end of the rod and is partially or not threaded along the remaining portion thereof. The section of the threaded rod 20 may be fully circular or partially circular in shape.

The plastic casing 12 of the present invention is made of a rigid or semi-rigid plastic material and can be provided selectively with a rubber grip. The plastic materials suitable for use in forming the casing 12 of the preseat invention include polyvinyl chloride, polyethylene, polyesters, polycarbonates, and copolymers or polymer blends consisting of the above-mentioned polymers.

The casing 12 of the present invention is formed by any one of the appropriate plastic molding processes which are well known in the art.

The advantages inherent in the present invention are described hereinafter.

The casing 12 of the hammer of the present invention is securely adhered to the threaded rod 20, thanks to the threaded outer surface of the threaded rod 20.

Both the casing 12 and the threaded rod 20 of the handle 10 of the present invention are securely fastened to the head 30 because the gap formed between the polygonal area 33 of the hole 31 of the head 30 and the threaded rod 20 is filled with one end of the casing 12, thereby preventing the threaded rod 20 from rotatably loosening off the threaded area 32 of the head 30. In addition, the casing 12 of tile handle 10 is capable of mitigating the shock generated by the pounding of the head 30.

What is claimed is:

1. A hammer comprising a handle and a head fastened to one end of said handle, one end of said handle being received securely in a hole disposed centrally in said head, said hole of said head being provided in an outer end thereof with a threaded portion and in an inner end thereof with a polygonal portion having a cross-section that is polygonal in shape and a cross-sectional area greater than that of an area of a cross-section of said outer end of said handle, said handle including a threaded rod and a casing of plastic material, said threaded rod having one threaded end engageable with said threaded portion of said head, said casing covering securely and entirely said threaded rod, except the one threaded end of said threaded rod which is engageable with said threaded portion of said head, and having one end thereof substantially filling a gap formed between said polygonal portion of the hole of said head and said threaded rod.

2. The hammer of claim 1 wherein said head is selected from the group consisting of an engineering plastic material, a ceramic material and a fiber-reinforced plastic composite material.

3. The hammer of claim 1 wherein said hole extends entirely through said head.

4. The hammer of claim 1 wherein said outer end of said hole is circular in cross-section and said threaded portion constitutes a thread formed on an inner wall of the circular outer end of said hole.

5. The hammer of claim 1 wherein said polygonal portion of said head has a cross-sectional shape selected from the group consisting of triangular, tetragonal, pentagonal, hexagonal, heptagonal, and octagonal.

6. The hammer of claim 1 wherein said threaded rod has a partially threaded outer surface.

7. The hammer of claim 1 wherein said threaded rod has a circular cross-section.

8. The hammer of claim 1 wherein said head is made of metal.

9. The hammer of claim 1 wherein said casing is further concrete with rubber grip thereon.

10. The hammer of claim 1 wherein said casing is formed by a plastic molding process.

11. The hammer of claim 1 wherein the outer end of said hole is oval in cross-section and said threaded area constitutes a thread formed on an inner wall of the oval outer end of said hole.

* * * * *